United States Patent [19]

Knetzger

[11] Patent Number: 4,871,176

[45] Date of Patent: Oct. 3, 1989

[54] GAMING METHOD AND APPARATUS

[75] Inventor: Robert C. Knetzger, Kirkland, Wash.

[73] Assignee: NeoToy Partnership, Arlington Heights, Ill.

[21] Appl. No.: 165,766

[22] Filed: Mar. 9, 1988

[51] Int. Cl.[4] ..... A63F 9/00

[52] U.S. Cl. ..... 273/237; 273/1 E; 273/85 G; 434/308; 434/335

[58] Field of Search ..... 273/1 E, 85 G, 138 A, 273/237, 238, DIG. 28; 434/350, 321, 336, 307, 308

[56] References Cited

U.S. PATENT DOCUMENTS

| | | | |
|---|---|---|---|
| 3,803,728 | 4/1974 | Scott | 434/308 |
| 3,964,179 | 6/1976 | Bennett | 434/308 |
| 4,372,554 | 2/1983 | Orenstein | 273/1 E |
| 4,586,905 | 5/1986 | Groff | 434/308 |
| 4,609,358 | 9/1986 | Sangster | 434/307 |
| 4,684,349 | 8/1987 | Ferguson et al. | 434/308 |
| 4,729,564 | 3/1988 | Kuna et al. | 273/1 E |

*Primary Examiner*—Leo P. Picard

*Attorney, Agent, or Firm*—Juettner Pyle Lloyd & Verbeck

[57] ABSTRACT

A gaming apparatus for use with prerecorded media or material, such as audio or video tape, to be selectively played through a conventional player/recorder, such as an audio or video tape player, is disclosed. The play of the prerecorded material in the conventional player is controlled by a token operated unit which contains switching circuits to selectively connect the player to a monitor, such as a speaker or ear or headphones, in the case of an audio message, and a television type monitor in the case of a video message. The prerecorded material and tokens interrelated with other game paraphernalia, such as a game board, etc., as desired to provide a game which includes an audio and/or video output as part of the game engineering.

29 Claims, 2 Drawing Sheets

GAMING METHOD AND APPARATUS

This invention relates to a gaming method and apparatus for use with prerecorded material playable on a conventional player device, and more particularly to a gaming method and apparatus that is activated by a game token to selectively play the prerecorded material.

BRIEF DESCRIPTION OF THE PRIOR ART

Prerecorded material, such as in the form of records, discs or tapes have been long used with various tape player devices, be they an audio tape recorder or player, video recorder or player, or computer. Attempts have been made to use such a player device in game various situations, be it educational, such as training, or recreational. One of the disadvantages, heretofore, of using such a device was that the prerecorded material was arranged in series and had to be played in the sequence in which it was recorded. This lack of randomness greatly limited the utility in constructing a gaming device which normally requires both skill and some degree of luck, the luck being provided by randomness. Lacking randomness, the prior art apparatus utilizing prerecorded material and a playing device usually resulted in a quickly anticipated or learned, and subsequently boring game. One simplistic approach that has been used in the past was to record a series of messages and just let the tape run. Another was to turn the volume down until it was inaudible or turn the player off, and then periodically turn the volume up or back on and play the message then on the tape or record. This procedure was then repeated over and over. The first method of play has been used in such games as the "Mother Goose" VCR game, published by Western Publishing Company. Of course a similar method could also be used with video messages as well as has been done in some video tape football games. The operator/-player manipulations required were tedious and quite boring as they themselves did not relate to the game in any manner.

Players readily accept game cards or tokens as part of any game, be it for education, training or entertainment, and they have been part of many prior art games. While many games have utilized game cards or tokens as part of the game play, heretofore, it has not been known to utilize such a game card or token to selectively activate a playing device.

BRIEF SUMMARY OF THE INVENTION

The present invention is a gaming method and apparatus which utilizes prerecorded media or material playable on a conventional playing device, such as a audio or video player, that is selectively playable in a random manner, by use of one or more game tokens which are insertable in a selectively activating means or control unit. The control unit continuously receives signals form the conventional player and has switch means or circuits therein selectively operable by the token to determining whether the signal is to be actually heard or seen. The selectively activating means or control unit is, in turn, connected to a monitor or playing device, such as an audio speaker or television, which will communicate the prerecorded message in an understandable form to the game player/operator. By structuring the selectively activating means or control unit to have a plurality of switches and or to utilize a plurality of tokens, additional randomness is provided in a form which can be easily interrelated to game play.

Preferably the switch or switches can be mechanically operated by the token or tokens, but other forms such as magnetic or light operated switches could be utilized. In a mechanical system the switch device could be a single pole single throw type providing two states (on or off) or codes or a single pole double throw type providing three states (on A, on B or off) or codes. The tokens could likewise be double or triple coded to operate a single throw or double throw type switch, respectively. Also there could be a single switch device or a plurality in series, in parallel or in any combination to accomplish the complexity of the game engineering desired.

The switching device, be it mechanical, magnetic or light operated, preferably is part of a housing having a slot for receiving the game token or tokens. The housing and tokens can be provided with additional coding adding an additional facet to the game engineering. Further, two or more tokens can be played simultaneously to further alter the response (by operating one or more switches), and yet further add another facet to the game engineering.

Should it be desired, one or more of the switch devices, such as of the double throw type, can be used to alter the switch configuration of the circuit, say on one throw placing other switches in parallel and on its other throw in series. Thus, even in a simple control unit with a few switches and a plurality of coded tokens, the possible outcomes greatly multiply and greatly enhance the game's randomness and playing opportunities, particularly when coupled to a plurality of audio and/or video signal messages provided on the prerecorded material.

Of course, normal game paraphernalia, such as a game board, player toker's and dice or a spinner, for example, could be incorporated with the gaming method and apparatus of the present invention.

A primary object of the gaming method and apparatus of the present invention is to provide for selectively playing of prerecorded material in response to one or more game tokens.

Another object of the gaming method and apparatus of the present invention is to provide an audio and/or video output which is controlled by one or more game tokens.

Yet another object of the gaming method and apparatus of the present invention is to provide game tokens which control a video and/or audio output from a conventional recorder/player.

Still another object of the gaming method and apparatus of the present invention is to provide game tokens which while controlling the audio and/or video output can also be coordinated and coded to the game.

Yet another object of the gaming method and apparatus of the present invention is the provision of a game token operated switch to control the audio/video output.

These and other object of the present invention will become apparent from the accompanying figures of the drawings and the following written description.

DESCRIPTION OF THE PREFERRED EMBODIMENT

Figure 1:
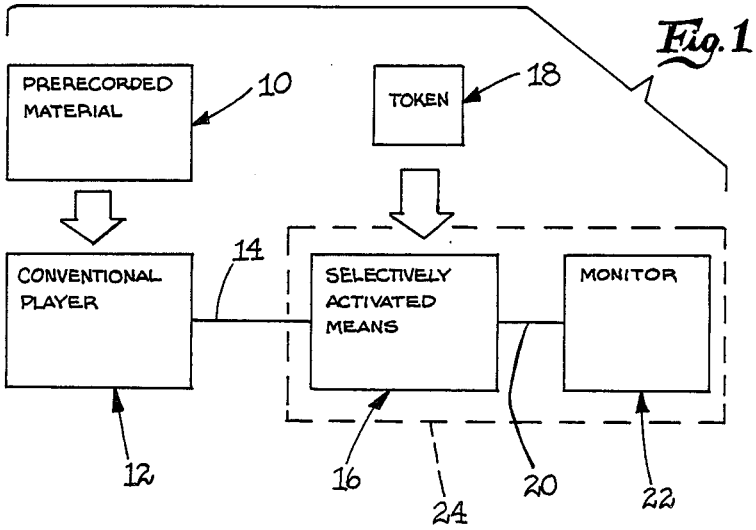
FIG. 1 is a schematic diagram of a portion of the gaming apparatus of the present invention.

In FIG. 1, a schematic of a portion of the gaming apparatus of the present invention is illustrated, and this portion can be used with any other conventional game paraphernalia (not shown), such as for example, a game board, player tokens, cards, dice, spinners, etc., to play a game for educational, entertainment or any other purpose. The gaming apparatus includes prerecorded material 10, which may be on any conventional recording media, such as disc, tape, floppy disc, hard disc, etc., for use with an appropriate player device. The prerecorded material contains game instructions and/or game play messages and is designed to be played in a conventional player device 12, be it a tape recorder/-player, video recorder, computer disc drive and/or computer, etc. The conventional player is connected via a pair of wires 14 to a selectively activated means or control unit 16. The selectively activated means or unit 16, in turn, can receive one or more game tokens 18 which can control the output from the conventional player 12. The selectively activated means or control unit 16 is connected by another pair of wires 20 to a monitor device 22, which in the case of an audio player could be a speaker or headphone/earphone, and with a video player a television or other screen type monitor.

For simplicity sake, we will assume the prerecorded material 10 is a prerecorded audio cassette, the conventional player 12 is a monaural tape recorder/player with an earphone jack and the monitor 22 is an audio speaker. As is indicated by the dotted line 24, the selectively activated means and the monitor or speaker 22 could be incorporated in a single housing rather than being separate. Of course, the monitor 22 could also be one or more earphones, say one for each player. One end of the pair wires 14 is plugged into the earphone jack of the tape recorder/player to connect it to the selectively activated means or control unit 16.

Figure 2:
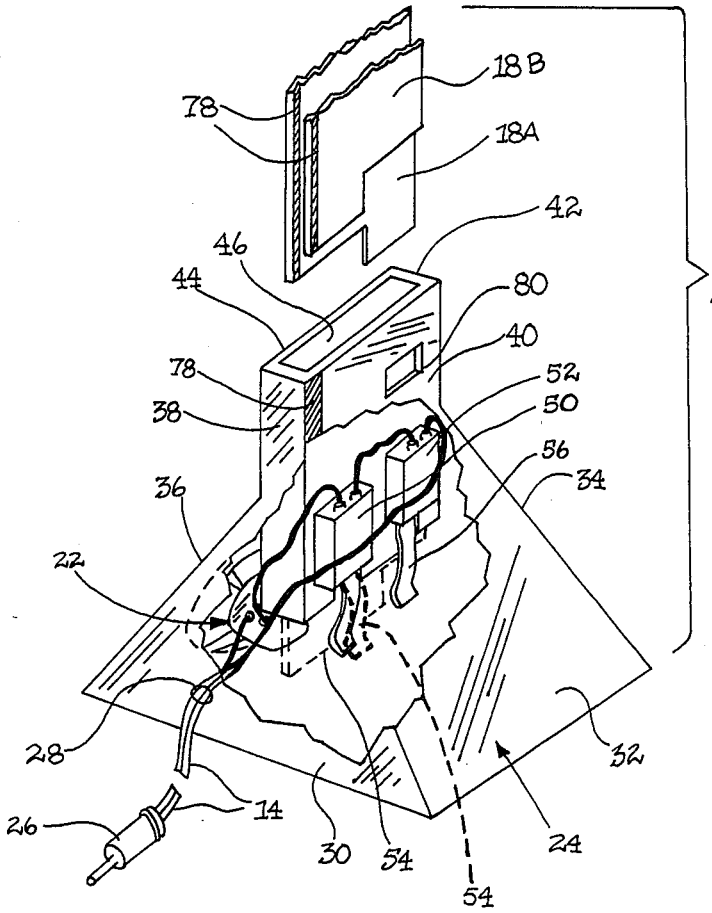
FIG. 2 is a perspective view of the selectively activated means shown schematically in FIG. 1, with portions thereof broken away to show its interior makeup and it game token operation.

Referring to FIG. 2, the selectively activating means 16, the monitor or speaker 22 and housing 24 are shown. The pair of wires 14 is also shown, and at its outer end is fitted with a conventional jack 26 which can be plugged into the earphone jack of the tape recorder/-player 12. The wires 14 enter an opening 28 formed in one side of the housing 24.

The housing 24 has a generally rectangular base from which extend four sides 30, 32, 34 and 36. The housing has a generally rectangular upper portion above with four sides 38, 40, 42 and 44 which form a game token receiving slot 46. Within the housing, in this instance, are a pair of conventional switches 50 and 52. While two switches are shown, more or less could be used. Each switch has a pair of electrical contacts, and the switches 50 and 52 are connected by wire in series with the monitor or speaker 22 which, in this instance, is also contained within the housing 24. Each of the switches 50 and 52 have mechanically activated arms 54 and 56 which when engaged by the token cause the switch to changed state (indicated by the dotted position and reference numeral 54), be it from open to closed or vice versa. The switches shown are of the single pole single throw type, but could be of the single pole double throw type, if desired. In the latter case, each switch would have three states. Of course, any other type switch could be used, and the switches could be activated by any means other than mechanical means, such magnetically or by light activation, for example. The switches 50 and 52 are located and mounted in the housing 24 in such a manner that their respective arms 54 and 56 can detect the presence (and one or more position codes) or absence of one or more game tokens 18 inserted into the slot 46.

Figure 3:
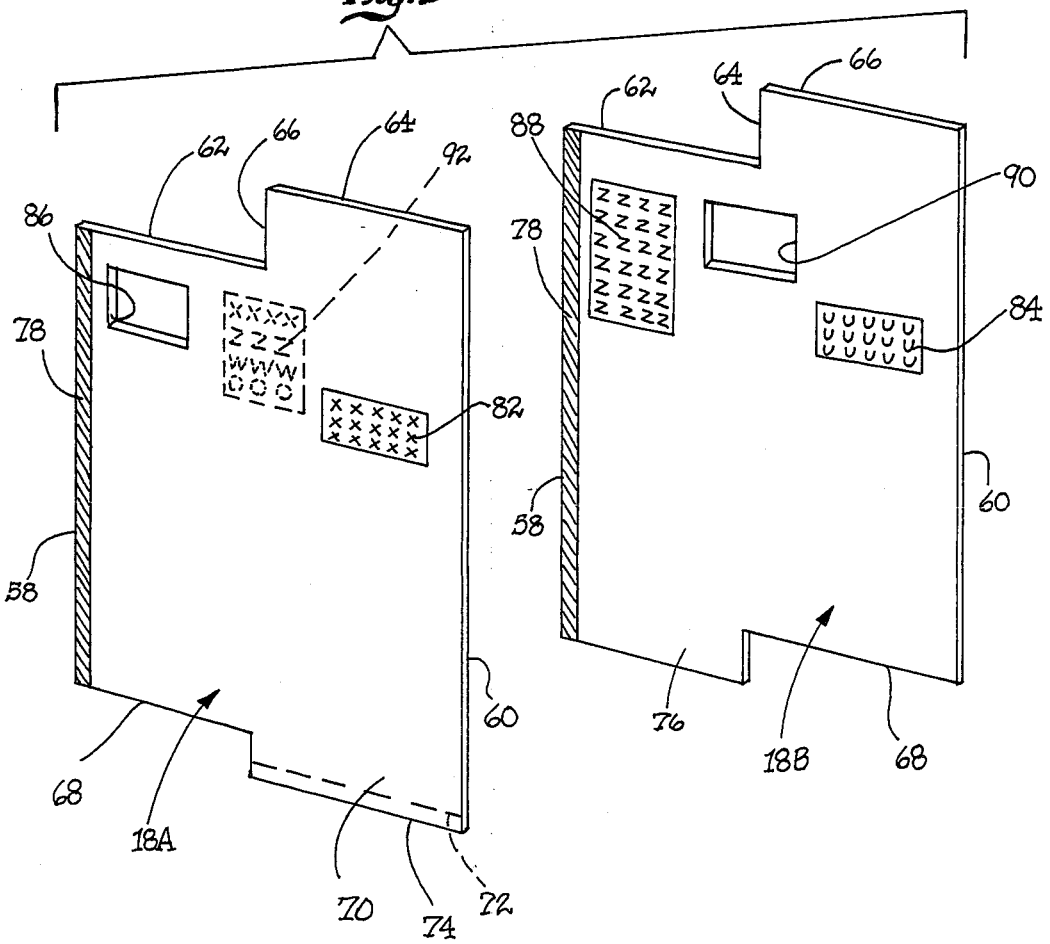
FIG. 3 is a perspective view of several game tokens of the type partially shown in FIG. 2 and illustrating how the tokens may bear additional game coding.

Referring to FIGS. 2 and 3, the game tokens 18 can comprise one or more individual pieces, which for convenience of description will be denoted game tokens 18A and 18B. Of course, it should be understood there can be as many game tokens as desired. As can be seen in FIG. 3, portions of tokens 18A and 18B are similar or identical, while other portions are different. Each game token generally comprises, preferably, a flat card, made of paper, plastic or metal. The side margins 58 and 60 of the tokens are spaced apart a distance to be received in the game token slot 46. The top margins 62 and 64 of the cards are stepped at 66 for purposes of providing ready access to the tokens, such as for index tabs.

The lower margin 68 of the token 18A is coded to operate one of the switches, and depending upon how it is inserted into the housing, it could be switch 50, or if reversed, switch 52. To this end a switch operating tab 70 is formed on the right side of token 18A, as shown in FIG. 3. Of course if the switch were a single pole double throw type, the switch tab 70 could be also coded to move the switch to any one of its three positions, as indicated by the dotted lines 72, or solid line 74, the other portion being obtained by eliminating the code tab 70 altogether to make the bottom right level with the left bottom margin 68. Likewise, the lower margin of card 18B is coded to operate one of the switches 50 and 52 and has a similar coded switch operating tab 76 thereon.

Assuming the card 18B is coded to operate a single pole single throw switch, then the two code positions possible for such switch can be achieved simply by providing or omitting the code tab 76.

Additionally, to establish how the game tokens are to be inserted into the game token slot, it or its housing and the tokens may be coded, as for example, by the same colored strip 78 appearing on each of the tokens and slot housing. Of course, the tokens could be arranged in two or more sets and the housing appropriately coded differently for each set, such as on opposite faces of the housing and or in different colors.

Additional coding can be provided between one or more of the game tokens and the housing itself. For example, the housing 24 could be provided with one or more windows or other areas 80 (FIG. 2) through which special messages such as 82 and 84 of cards or tokens 18A or 18B would be visible. Yet additional coding could be provided between the various game tokens themselves. For example, token 18A has a window or area 86 therein, which when that token is aligned with token 18B, will permit viewing of a portion of a message 88 on token 18B. Of course, the window area on other tokens (not shown) could be used to view other portions of the message 88 not visible &through the window 86 of token 18A. Similarly, token 18B could be provided with its own area or window 90 through which to view a message 92 (indicated in dotted lines) or a portion thereof on the backside of token 18A. There various coded message areas and windows are representative of additional coding that could be done and are not limited to a particular format.

While in FIG. 2, the token slot 46 is shown receiving two tokens 18A and 18B, it could be constructed to receive one or three or more game tokens.

In operation, in the method of the present invention, the game material is prerecorded on the tape with instructions and/or play moves as required by the game engineering. The prerecorded material 10 is then inserted into and played in the conventional player 12; and one or more tokens 18, 18A, 18B, etc., are inserted into the selectively activated means 16 in accordance with the game rules. Then, when the token 18, 18A, 18B, etc., connect up in an appropriate circuit, via switches 50, 52 or others, the recorded message will be received by the monitor 22 and played. Of course, the message could be in an audio, video or both formats. The message can, of course, e utilized with conventional game paraphernalia, such as a game board, chance cards, which may also be tokens, dice and/or spinners, etc., to play a game.

While the preferred embodiment disclosed was with a monoral tape and tape player, a stereo tape and tape player could be used, if desired with separate messages recorded on each of two channels. For example, one player could listen to one channel only and a second to the other channel, or if desired, which of the multiple channels a player hears could be altered by other token operated switches. If privacy of communication is desired, earphones could be provided, one for each player and the stereo channels sent to one or more of the earphones, separately or simultaneously as desired. Of course, additional channels could also be used, such as four or more, such being provided by quad track equipment, two sets of stereo equipment or four sets of monoral equipment and appropriate prerecorded media. Were a video recorder and television monitor used instead of a tape player and a speaker, the control unit 16 would be located between the normal VCR-TV connection. The control unit could also be similarly connected to control the output of a computer to its input or output devices. Also, one or more of the switches could be used to control the power to the conventional player so that a token or tokens would turn it "on" or "off", adding randomness.

While the preferred embodiment of the gaming method and apparatus of the present invention has been illustrated and described, from the foregoing to should be understood that variations, modifications and equivalent steps and structure fall within the scope of the appended claims.

What is claimed is:

1. A gaming apparatus for use by one or more players with a conventional playing device for playing prerecorded material, comprising prerecorded game material containing a plurality of messages adapted to be used by one or more players and played in said playing device, monitoring means for presenting a message from said prerecorded game material played on said playing device, selectively activating means for selectively playing said prerecorded game material, said selectively activating means being connected to said playing device and to said monitoring means for presenting at least one of said messages, two or more tokens having a coded segment for operating said selectively activating means, said selectively activating means having a token receiving portion for receiving at least two or more of said tokens at a time for rendering said selectively activating means operable to connect or disconnect said playing device to said monitoring means for presenting at least one message from said prerecorded game material, whereby one or more messages may be presented from said prerecorded game material on said monitoring means when said coded segments of said two or more tokens causes said selectively activating means to connect said playing device to said monitoring means.

2. A gaming apparatus as in claim 1, wherein said conventional playing device includes an audio message, and said means for presenting a message includes an audio speaker, two or more of said tokens being provided, each with a different coded segment, said selectively activating means including contact means for one of connecting and disconnecting said playing device to said monitoring means for presenting a signal, said coded segment of said token operating said contact means, said token being a flat member, said coded segment being formed in said flat member, a game board, said game board, prerecorded material, and two or more tokens being interrelated to one another to play a game, and a housing having a slot therein to receive said tokens, said selectively activating means being located in said housing adjacent said slot.

3. A gaming apparatus as in claim 2, wherein said conventional playing device includes a video tape player and a video monitor, and said prerecorded material includes a video message.

4. A gaming apparatus as in claim 1, wherein said conventional playing device is an video tape player and said means for presenting a message is a video monitor.

5. A gaming apparatus as in claim 4, wherein said conventional playing device includes an audio message, and said means for presenting a message includes an audio speaker.

6. A gaming apparatus as in claim 1, wherein said selectively activating means includes contact means for one of connecting and disconnecting said playing device to said monitoring for presenting a signal, said coded segment of said tokens operating said contact means.

7. A gaming apparatus as in claim 1, further comprising a housing, a wherein said selectively activating means and said monitor means being contained are in said housing.

8. A gaming apparatus as in claim 7, wherein said housing has a slot therein to receive said tokens, said selectively activating means being adjacent said slot and operated by said tokens.

9. A gaming apparatus as in claim 1, wherein said token is a flat member.

10. A gaming apparatus as in claim 9, wherein said coded segment is formed on a margin of each of said flat members.

11. A gaming apparatus as in claim 1, further comprising a game board, said game board, prerecorded material, and two or more tokens being interrelated to one another to play a game.

12. A gaming apparatus as in claim 1, wherein said playing device is a plural channel player and said prerecorded material has a plurality of channels of prerecorded material, and said means for selectively activating includes means for selectively playing each of said channels separately.

13. A gaming apparatus as in claim 1, wherein said prerecorded material includes game instructions.

14. A gaming apparatus as in claim 1, wherein said prerecorded material is in the format of a telephone call, including ringing and a message.

15. A gaming apparatus as in claim 1, wherein said conventional playing device is an audio tape player and said means for presenting a message is an audio speaker.

16. A gaming apparatus as in claim 15, wherein said audio speaker is in the form of an earphone.

17. A gaming apparatus as in claim 16, wherein a plurality of earphones are provided, one for each player, said selectively activating means having means operated by said tokens for connecting and disconnecting one or more of said plurality of earphones to said player, whereby some of said players may hear a message while others do not hear the message.

18. A gaming method for use by one or more players using a recording media, a conventional player device for the recording media, a monitor and a switch circuit operated by a token, comprising the steps of:

prerecording game material on the recording media;

inserting the prerecorded media into the conventional player device;

connecting the switch circuit between the output of the conventional player device and the input of the monitor;

continuously playing the prerecorded media on the conventional player device during game play; and inserting a token into the switch circuit to permit the transmission of the prerecorded media from the monitor.

19. A gaming method as in claim 18, comprising the step of altering the switch circuit between the conventional player device and monitor by inserting one or more tokens.

20. A gaming method as in claim 18, comprising the step of providing each player with a separate monitor isolated from the monitor of the other players, and altering the switch circuit between the conventional player device and each player's monitor by inserting a token so that not all players receive the prerecorded material being played.

21. A gaming method as in claim 18, wherein the prerecording step includes the step of providing game plays on said recording media.

22. A gaming method as in claim 21, wherein the prerecording step includes the step of providing game instruction on said recording media.

23. A gaming method as in claim 18, including the additional step of controlling the "on"- "off" operation of the conventional player device with the insertion of a token.

24. A gaming apparatus for use by one or more players with an audio playing device for continuously played prerecorded material, comprising prerecorded game material containing a plurality of messages adapted to be used by one or more players and continuously played in said audio playing device during game play, audio monitoring means for presenting a message from said prerecorded game material played on said audio playing device, selectively activating means for selectively playing said continuously played prerecorded game material, said selectively activating means being connected to said audio playing device and to said audio monitoring means for selectively presenting at least one of said messages, one or more physical tokens having a coded segment for operating said selectively activating means, said selectively activating means having a token receiving portion for receiving one or more of said tokens for rendering said selectively activating means operable to connect or disconnect said audio playing device to said audio monitoring means for presenting at least one message from said continuously played prerecorded game material, whereby one or more messages may be presented from said continuously played prerecorded game material on said audio monitoring means when said coded segment of said one or more tokens causes said electively activating means to connect said audio playing device to said audio monitoring means.

25. A gaming apparatus as in claim 24, wherein said audio playing device is a tape player and said audio monitoring means is an audio speaker.

26. A gaming apparatus as in claim 24, wherein said audio playing device is an video tape player and said audio monitoring means is a television set.

27. A gaming apparatus as in claim 24, wherein said audio playing device is a plural channel player and said prerecorded material has a plurality of channels of prerecorded material, and said means for selectively activating includes means for selectively playing each of said channels separately.

28. A gaming apparatus as in claim 24, wherein said audio monitoring means comprises a plurality of earphones, one for each player, said selectively activating means being token operated for connecting and disconnecting one or more of said plurality of earphones, one for each player, said selectively activating means being token operated for connecting and disconnecting one or more of said plurality of earphones to said audio playing device, whereby some of said players may hear a message while others do not hear the message.

29. A gaming apparatus as in claim 24, wherein said selectively activating means includes a token operated "on"- "off" power switch for said audio playing device and adapted to be connected to a power source, said audio playing device having a power input card connected to said token operated "on"- "off" switch.

* * * * *